US007958917B2

(12) United States Patent
Conforti

(10) Patent No.: US 7,958,917 B2
(45) Date of Patent: Jun. 14, 2011

(54) VALVE UNIT FOR FILLING MACHINES

(75) Inventor: Lucio Conforti, Fornovo Di Taro (IT)

(73) Assignee: Sidel Holdings & Technology S.A., Pully (CH)

( * ) Notice: Subject to any disclaimer, the term of this patent is extended or adjusted under 35 U.S.C. 154(b) by 1053 days.

(21) Appl. No.: 11/749,327

(22) Filed: May 16, 2007

(65) Prior Publication Data

US 2007/0284013 A1 Dec. 13, 2007

(30) Foreign Application Priority Data

May 24, 2006 (EP) ..... 06425352

(51) Int. Cl.
*B65B 1/30* (2006.01)

(52) U.S. Cl. ..... 141/95; 141/198; 141/293; 141/302

(58) Field of Classification Search ..... 141/4–7, 141/39, 40, 44–50, 57, 59, 63–67, 198, 293, 141/302, 305, 307
See application file for complete search history.

(56) References Cited

U.S. PATENT DOCUMENTS

| | | | | |
|---|---|---|---|---|
| 3,633,635 | A * | 1/1972 | Kaiser | 141/40 |
| 4,787,428 | A * | 11/1988 | Bacroix et al. | 141/39 |
| 4,982,768 | A * | 1/1991 | Ahlers | 141/6 |
| 5,501,253 | A * | 3/1996 | Weiss | 141/40 |
| 5,564,481 | A * | 10/1996 | Clusserath | 141/92 |
| 6,109,483 | A | 8/2000 | Wilke et al. | |
| 6,470,922 | B2 * | 10/2002 | Sindermann | 141/37 |
| 6,474,368 | B2 * | 11/2002 | Clusserath et al. | 141/6 |
| 7,311,125 | B2 * | 12/2007 | Krulitsch | 141/149 |

FOREIGN PATENT DOCUMENTS

| | | |
|---|---|---|
| DE | 4444346 | 6/1996 |
| DE | 202005001188 | 5/2005 |
| EP | 0521475 | 1/1993 |
| EP | 0601514 | 6/1994 |

* cited by examiner

*Primary Examiner* — Timothy L Maust
(74) *Attorney, Agent, or Firm* — Shoemaker and Mattare

(57) ABSTRACT

The present invention relates to a valve unit for container filling machines, particularly for glass bottle fillers.

More particularly, the present invention relates to a valve unit (1), particularly for container filling machines (8), comprising a hollow body (2) in which there is slidably housed a plug (3), wherein said plug (3) is hollow and comprises an outer duct (23) and an inner duct (24) coaxial to said outer duct (23), a probe (28) having a smaller diameter than the opening of said inner duct (24) being coaxially housed within said inner duct (24), characterized in that said inner duct (24) is made of electrically isolating material.

13 Claims, 1 Drawing Sheet

VALVE UNIT FOR FILLING MACHINES

FIELD OF THE INVENTION

The present invention relates to a valve unit for bottle filling machines.

BACKGROUND ART

For filling containers, it is known to use either inline or rotary equipment, which are provided with a plurality of suitable tap or filling valves equipped with nozzles closed by a plug. The plug consists of a stem movable along the axis thereof, in order to allow opening and closing the valve in a controlled manner. During the filling operation, the container mouth is sealingly abutted on the valve gasket, thereby creating a closed environment therewith.

When filling glass bottles, the filling valves can provide the possibility of releasing the air contained within the bottle and replace it with sterile air. With carbonated beverages, particularly, the process requires to be carried out with air or other inert gas under pressure, in order to avoid excessive foaming. A release duct is further essential to be provided for the gas which has to leave the bottle, such as to facilitate the completion of the filling operation.

In order to achieve this, the plug is hollow and comprises service co-axial ducts, in order to create a vacuum inside the bottle and subsequently introduce inert gas during the filling operation, as well as to create a vent for the gas.

Furthermore, in a central position relative to the innermost duct, there is normally positioned a suitable probe that extends within the container, reads the filling level, and stops the delivery of the beverage when the preset level has been reached. The probe is coated with isolating material, such as plastic or ceramic material, to avoid that contacts may be created with the metal wall of the surrounding duct, which would result in a short-circuit that would invalidate the probe reading.

A first problem encountered with this type of valves is that the probe coating can be damaged due to wear, thus exposing probe parts that may come in contact with the metal duct, with the above-mentioned consequences.

Furthermore, the probe, which consists of a long and thin stem, requires a centering device. This centering device, which is provided by means of a ring made of isolating material, is necessarily positioned at the mouth of the inner duct and may be thus subjected to bottle burst or excessive foaming. For this reason, the centering device is often damaged. Furthermore, if the latter is placed in the end position, it results to be inserted within the bottle neck, and consequently restrains the gas outflow.

SUMMARY OF THE INVENTION

The present invention thus addresses the above-mentioned problems, and solves them by means of a filling valve such as outlined in the annexed claims.

Further characteristics and advantages of the valve unit for filling machines being the object of the present invention will be better understood from the description of a preferred embodiment, which is given below by way of a non-limiting illustration.

DETAILED DESCRIPTION OF THE INVENTION

Figure 1:
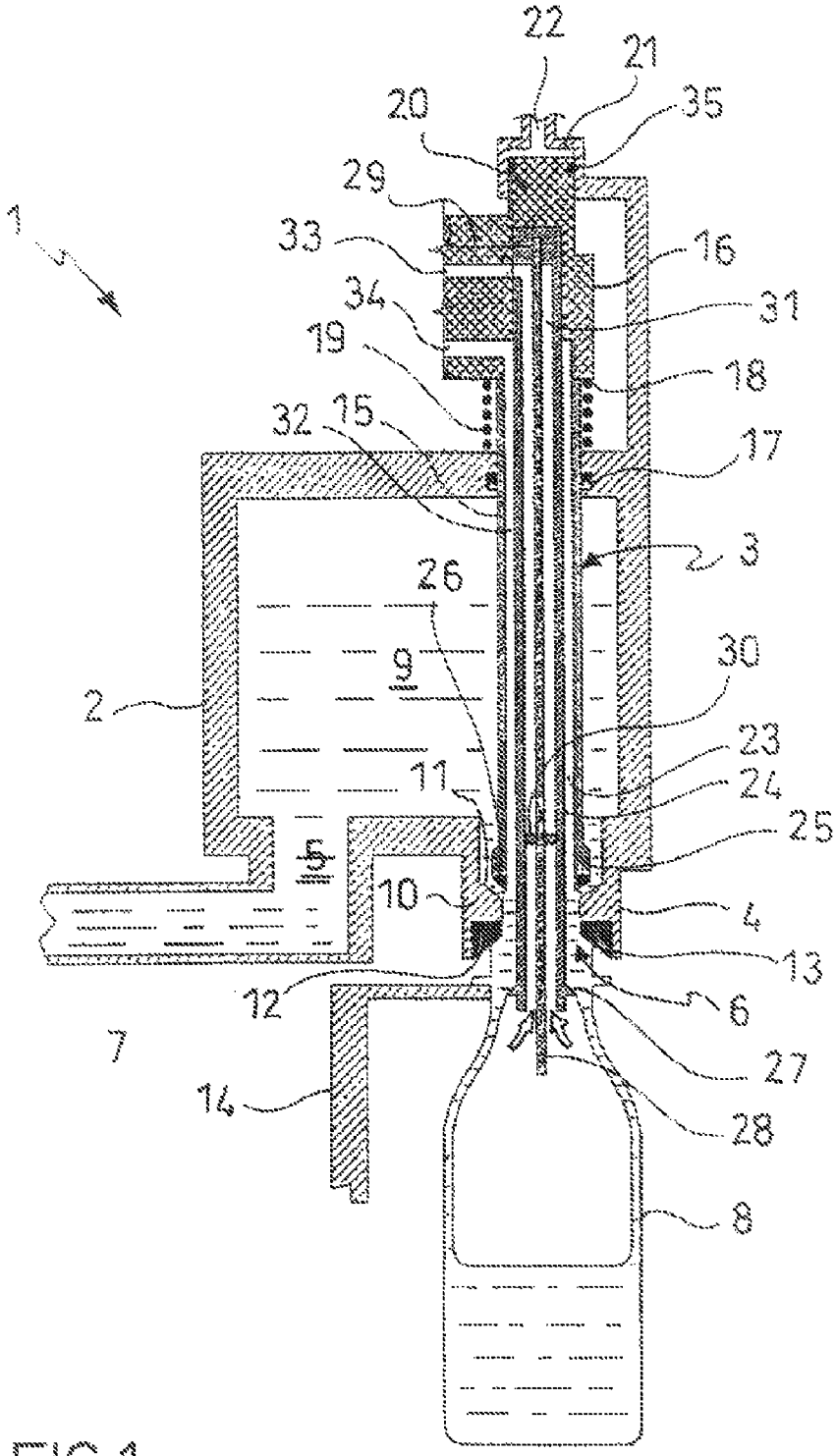
FIG. 1 is a side sectional schematic view of the valve unit of the invention, in an operative condition.

With reference to the FIGURE, the valve unit of the invention, which is generally designated with 1, comprises a hollow body 2, a plug 3 being slidably housed therein.

The hollow body 2 is fixed to the filling machine framework by means of suitable attachment means, such as brackets or other connection elements, not shown.

The hollow body 2 comprises an inlet aperture 5 and an outlet aperture 6 for the filling fluid of the container 8. Said inlet aperture 5 is connected to a duct 7 for feeding the filling fluid. At the outlet aperture 6, which is formed on the lower surface of the hollow body 2, there is arranged a delivery nozzle 4 into alignment with the plug 3. A passageway 9 for the filling fluid will be thus defined within said hollow body 2.

The delivery nozzle 4 comprises, on the inner surface thereof, a thickening which forms a shoulder 10. The shoulder 10 comprises an upper portion 11 being tapered downwards, which is an abutment surface for the plug 3; and a lower portion 12 being tapered upwards, on which there is arranged a gasket 13 made of rubber or other soft material, said lower portion 12 being an abutment surface for the container neck 8.

The container 8 will be generally supported by a plate (not shown) and/or a suitable gripper 14, which holds it at the neck and the whole will be placed on suitable moving means, either of linear or rotary type, which are not shown as they are fully conventional.

The plug 3 comprises a stem 15, and a head 16. The stem 15 passes through the upper wall of the hollow body 2 and is slidably housed in a suitable hole formed therein. The surface of this hole comprises a sealing gasket 17 to prevent the filling fluid from leaking out. This hole also acts as a guide means for the plug 3.

The head 16 comprises a downward-facing shoulder 18. Between said shoulder 18 and the outer face of the hollow body 2, in a coaxial position relative to the stem 15 of the plug 3, there are arranged elastic means 19, such as a helical spring, which, in the rest condition, act such as to hold the plug in the retracted position (the valve is open).

The head 16 comprises a plunger 20 on top thereof, which is slidable within a chamber 21 integral with the structure of the hollow body 2 and in which there is introduced, via an aperture 22 connected to the pressurization means (not shown), a pressurized fluid for pneumatically driving the plug.

The plunger 20 is provided with a sealing gasket 35, such a an O-ring.

The stem 15 of the plug 3 is hollow, and comprises an outer duct 23 and an inner duct 24 being coaxially arranged relative thereto.

The outer duct 23 has a thickened lip 25 on the lower part thereof, which has a surface that is tapered downward and provided with a gasket 26, such as an O-ring. This gasket 26 is intended to be in abutment interference with the shoulder 10 of the delivery nozzle 4, when the valve unit 1 is in the closed condition.

The inner duct 24 projects below the outer duct 23, such as to be inserted within the neck of the container 8, when the latter is rested on the delivery nozzle 4, and comprises deviating means 27 on the outside, at the lower end thereof. The deviating means 27 have the function of allowing, upon delivery, the filling fluid to be distributed along the walls of the container 8, thereby facilitating a smooth filling of the container.

A probe 28 is arranged coaxially of the inner duct 24, which probe consists of a long and thin stem made of electrically conductive material, preferably not coated with an electrically isolating material. The probe 28 is further protruding also relative to the inner duct 24 and projects within the container 8 to the point that has been selected as the container filling level. At the opposite end, the probe 28 is fixed to the head 16 of the plug 3, and is operatively connected to a control and command unit (not shown) for example by means of a suitable wiring 29 or wireless systems, which control and command unit provides to detect the signal from the probe 28 and sends an open/close command to the actuating pneumatic means of the plug 3.

The essential characteristic of the valve unit according to the present invention is that the inner duct 24 is made of an electrically isolating material, particularly plastic material, such as Teflon, PEEK (polyether-ether ketone) or PVDF (polyvinylidene fluoride).

The inner duct 24 comprises centering means 30 for the probe 28. Said centering means 30, which are made of electrically isolating material, are arranged in a retracted position relative to the lower end of the inner duct 24, such as to prevent them from being damaged in the event of bottle burst or excessive foaming. Preferably, said centering means 30 are made as one piece with the inner duct 24, such as by means of injection moulding. The provision of the inner duct 24 as one piece with the centering means 30 by means of moulding allows these centering means to be positioned in the desired position, which would be much more difficult if the centering means had to be applied within the duct 24 at a later time, as it is required with the known valves. In the latter, in fact, the centering ring made of isolating material is disadvantageously positioned at the end of the inner duct, with the above-mentioned consequences.

The diameter of the probe 28 is smaller than the opening of the inner duct 24, such that a first annular passageway 31 is created between the probe and the surface of the inner duct 24, which is generally used as a release channel for the air contained within the bottle during the filling operation.

A second annular passageway 32 is created between inner duct 24 and outer duct 23, for applying the vacuum to the container 8.

Said first 31 and second 32 annular passageways are respectively in flow communication with relative channels 33, 34, which lead to a vent for the air and means for the vacuum (such as for example a vacuum pump), respectively, by means of suitable collectors (not shown). The channel 34 for applying the vacuum may also serve to introduce sterile air, possibly pressurized sterile air, simply by selecting a sterile air source rather than said vacuum means, by means of suitable valve means. As these characteristics are fully conventional, they will not be described in greater detail.

With further reference to the FIGURE, the operation of the valve unit according to the invention will be now described herein below.

In FIG. 1, the valve unit 1 is shown in a delivery condition, with a container 8 already positioned rested on the delivery nozzle 4 of the valve unit 1. The preceding steps of the operation provide the container 8 being positioned by means of the moving means of the latter, the air originally present within the container 8 being released via the second annular passageway 32, and the sterile air, possibly pressurized, being introduced via the same annular passageway 32.

Upon filling, the deviating means 27 provide for the filling fluid to be distributed along the container walls, thus minimizing the turbulence and leaving free access to the first annular passageway 31 for the inert gas to be released therethrough, which will have to leave the container 8 in order to allow the latter to be filled, such as shown by the arrows in the drawing.

The filling will be continued until the tip of the probe 28 is in contact with the filling fluid. At this stage, the probe will send a signal to the control and command unit, which will provide to trigger the actuating pneumatic means of the plunger 20. The plunger 20 will carry out a short travel downwards, thus loading the elastic means 19 until the plug 3 is brought to the closure position of the aperture 6 of the valve means 1.

The advantages of the valve unit being the object of the present invention will be immediately appreciated from what has been described above.

First, as the inner duct 24 has been made of isolating material (plastics), rather than of metal as in the prior art, a substantial advantage is achieved in that the problem concerning the possible short-circuits resulting from damages to the isolating coating of the probe 28 is completely eliminated. The probe 28, in this invention, will not require to be coated with the isolating material.

Another important advantage of the solution used in the present invention is that, as the inner duct 24 is made by means of injection moulding of plastic material, the centering means can be obtained as one piece in the most desired advantageous position, i.e. in a retracted position relative to the lower end of the duct 24. Thereby, not only any damage to the centering device is avoided, but also the retracted arrangement allows changing, when required (for example, in order to allow an improved inflow/outflow of the inert gas), the opening of the inner duct 24 in that point, without interfering with the size of the container neck, which is obviously fixed.

The valve unit of the invention will further result to be less expensive to manufacture, due to the lower number of pieces used (inner duct-centering means made as one piece) and due to the use of less expensive materials (inner duct 24 made of plastics).

It will be appreciated that only a particular embodiment of the valve unit being the object of the present invention has been described herein, to which those skilled in the art will be able to make any and all modifications necessary for its adjustment to specific applications, without however departing from the scope of protection of the present invention as defined in the annexed claims.

Again, the lifting of the plug 1 may be carried out against the resistance of the elastic means 19, thus defining a rest position in which the valve unit is in the closed, rather than opened, condition as in the example described above.

The invention claimed is:

1. A valve unit, particularly for container filling machines, comprising a hollow body, a plug slidably housed in said body, wherein said plug is hollow and comprises an outer duct and an inner duct coaxial with said outer duct, said inner duct having an inner diameter, a probe having a diameter less than the inner diameter of said inner duct and coaxially housed within said inner duct, wherein said inner duct is entirely made of electrically isolating material and said probe is bare, and further comprising centering means made of electrically isolating material arranged in a retracted location relative to the lower end of the inner duct, wherein said centering means are made as one piece with said inner duct.

2. The valve unit according to claim 1, wherein said inner duct is made of plastic material.

3. The valve unit according to claim 2, wherein said plastic material is selected from Teflon, PEEK (polyether-ether ketone) or PVDF (polyvinylidene fluoride).

4. The valve unit according to claim 2, wherein said inner duct is obtained by means of injection moulding.

5. The valve unit according to claim 1, wherein said inner duct projects below said outer duct such as to be positioned within the container in an operative condition.

6. The valve unit according to claim 1, wherein said probe projects below said inner duct to the point corresponding to the filling level selected for the container during operation of the valve unit.

7. The valve unit according to claim 1, wherein said plug comprises a first annular passageway for releasing the air and a second annular passageway for applying the vacuum and/or for the introduction of sterile, possibly pressurized, air within the container.

8. The valve unit according to claim 1, wherein said plug is actuated by pneumatic means.

9. The valve unit according to claim 8, wherein the movement of said plug for closing said valve unit is carried out against the resistance of elastic means arranged between the head of said plug and the surface of said hollow body.

10. The valve unit according to claim 1, wherein the outer duct of said plug comprises a lip at the lower end thereof, said lip having a tapered downward surface comprising a gasket.

11. The valve unit according to claim 1, wherein said hollow body comprises, at the lower part thereof, a delivery nozzle having a shoulder arranged on the inner surface thereof, said shoulder comprising a tapered downward upper portion, which is an abutment surface for the plug; and a tapered upward lower portion, on which there is arranged a gasket, said lower portion being a rest surface for the neck of the container.

12. The valve unit according to claim 1, wherein said inner duct comprises on the outside, at the lower end thereof, deviating means for the filling fluid.

13. The valve unit according to claim 1, wherein said probe is operatively connected to a command and control unit which detects the signal from the probe and consequently provides to trigger said plug.

* * * * *